US007407022B2

(12) United States Patent
Mundell et al.

(10) Patent No.: US 7,407,022 B2
(45) Date of Patent: Aug. 5, 2008

(54) APPARATUS FOR PUMPING DRILL CUTTINGS AND DUAL CYLINDER POSITIVE DISPLACEMENT PUMP FOR MOVING DRILL CUTTINGS AND METHOD OF USE

(75) Inventors: David Mundell, Ardrossan (GB); David Stephen Garrick, Shetland (GB)

(73) Assignee: Clarke UK, Ltd., Coatbridge (GB)

( * ) Notice: Subject to any disclaimer, the term of this patent is extended or adjusted under 35 U.S.C. 154(b) by 221 days.

(21) Appl. No.: 11/191,246

(22) Filed: Jul. 27, 2005
(Under 37 CFR 1.47)

(65) Prior Publication Data

US 2006/0124361 A1 Jun. 15, 2006

(30) Foreign Application Priority Data

Jul. 27, 2004 (GB) ..... 0416706.0

(51) Int. Cl.
*E21B 21/01* (2006.01)

(52) U.S. Cl. ..... 175/66; 175/5; 175/206; 175/207; 406/104; 406/155; 406/197; 166/335; 417/532; 417/900

(58) Field of Classification Search ..... 175/5, 175/66, 206, 207; 166/335; 406/96, 104, 406/154, 155, 175, 197, 198; 417/532, 900
See application file for complete search history.

(56) References Cited

U.S. PATENT DOCUMENTS 4,198,193 A 4/1980 Westerlund et al.
4,221,503 A 9/1980 Cherrington
4,298,288 A 11/1981 Weisbrod
4,465,441 A 8/1984 Schwing
4,569,642 A 2/1986 Dwyer
4,614,483 A 9/1986 Hudelmaier
4,676,724 A 6/1987 Birdwell
4,708,212 A 11/1987 McAuley et al.
4,715,022 A 12/1987 Yeo
4,813,495 A * 3/1989 Leach ..... 175/6
4,979,884 A 12/1990 Letarte et al.
5,037,275 A 8/1991 Schlecht
5,180,294 A 1/1993 Watchorn
5,230,388 A 7/1993 Cherrington
5,302,094 A 4/1994 Schlecht et al.
5,351,764 A 10/1994 Cherrington
5,375,098 A 12/1994 Malone et al.
5,375,669 A 12/1994 Cherrington
5,402,855 A 4/1995 Gondouin
5,902,554 A * 5/1999 Kirkbride ..... 422/141
5,934,375 A 8/1999 Peterson
6,102,310 A 8/2000 Davenport
6,102,673 A 8/2000 Mott et al.

(Continued)

FOREIGN PATENT DOCUMENTS

EP 0410972 10/1992

(Continued)

*Primary Examiner*—Jennifer H Gay
*Assistant Examiner*—Sean D Andrish
(74) *Attorney, Agent, or Firm*—Thompson Hine LLP

(57) ABSTRACT

A dual cylinder positive displacement pump is used to move drill cuttings. The pump may include one or more of a self-sealing wear ring member/wear plate member interface, stainless steel pumping cylinders, and a hopper with an inclined surface.

28 Claims, 7 Drawing Sheets

U.S. PATENT DOCUMENTS

| | | | | |
|---|---|---|---|---|
| 6,186,747 | B1 | 2/2001 | Zhou et al. | |
| 6,286,592 | B1 * | 9/2001 | Moore et al. | 166/50 |
| 6,338,615 | B1 | 1/2002 | Hurr et al. | |
| 6,386,300 | B1 | 5/2002 | Curlett et al. | |
| 6,505,691 | B2 | 1/2003 | Judge et al. | |
| 6,533,946 | B2 * | 3/2003 | Pullman | 210/787 |
| 6,585,115 | B1 | 7/2003 | Reddoch et al. | |
| 6,588,318 | B2 | 7/2003 | Aday et al. | |
| 2003/0215344 | A1 | 11/2003 | Condon et al. | |
| 2004/0031622 | A1 | 2/2004 | Butler et al. | |
| 2005/0029015 | A1 * | 2/2005 | Burnett et al. | 175/5 |

FOREIGN PATENT DOCUMENTS

| | | |
|---|---|---|
| EP | 0425567 | 10/1992 |
| EP | 0562498 | 1/1996 |
| EP | 0656995 | 6/1996 |
| EP | 0561262 | 8/1996 |
| EP | 0736140 | 12/1997 |
| EP | 0925450 | 4/2002 |
| EP | 1055069 | 8/2002 |
| EP | 0988450 | 9/2002 |
| EP | 0849469 | 4/2003 |
| EP | 1053401 | 4/2003 |
| GB | 1569922 | 6/1980 |
| JP | 3107589 | 5/1991 |

* cited by examiner

APPARATUS FOR PUMPING DRILL CUTTINGS AND DUAL CYLINDER POSITIVE DISPLACEMENT PUMP FOR MOVING DRILL CUTTINGS AND METHOD OF USE

TECHNICAL FIELD

This application relates to a method for moving drill cuttings and a dual cylinder positive displacement pump configured to move drill cuttings or other material.

BACKGROUND

Drill cuttings are the by-product of drilling operations, in particular drilling operations for gas and oil wells. The cuttings include mud, sediment, rock and water as well as various oils, drilling fluids and the like. Because of the hydrocarbon content of drill cuttings, as well as other pollutants, it is desirable to treat the drill cuttings before disposal. Regardless of the mode of treatment and disposal, transport of drill cuttings has presented significant logistical problems, particularly when dealing with drill cuttings produced by offshore oil & gas drilling platforms. Due to the nature of the drill cuttings many types of pumps break down quickly and therefore cannot be used on a commercially viable basis for transporting drill cuttings.

SUMMARY

In one aspect, a pump for moving drill cuttings includes a hopper for receiving drill cuttings. A swing tube member is positioned within the hopper and has an outlet end in flow communication with a discharge port of the hopper, and an inlet end movable between first and second openings that communicate respectively with first and second pumping cylinders. The inlet end includes a wear ring member disposed thereabout for movement with the inlet end, the wear ring member abutting a stationary wear plate member adjacent a wall of the hopper, the stationary wear plate member defining the first and second openings. The inlet end of the swing tube member is disposed within the wear ring member, a sealing ring is located to provide a seal between the wear ring member and the swing tube member, and a presure ring is located to push the wear ring against the stationary wear plate member so as to hold said wear ring member in abutment with the wear plate member while still permitting the wear ring member to slide relative to the wear plate member. Both the sealing ring and the pressure ring are located outside a drill cuttings flow path defined by the wear ring member and swing tube member.

In another aspect, a method of moving drill cuttings involves the steps of placing drill cuttings in a hopper, said hopper including a swing tube member and communicating between a discharge port and alternately with first and second pumping cylinders. Respective piston heads within said first and second pumping cylinders are alternately reciprocated in synchronization with movement and positioning of said swing tube member to repeatedly: (i) draw drill cuttings into said first cylinder while at the same time forcing drill cuttings from said second cylinder through said swing tube member to said discharge port, (ii) pause while said swing tube member is transitioned from alignment with an outlet from said second cylinder to alignment with an outlet from said first cylinder, (iii) subsequently draw drill cuttings into said second cylinder while at the same time forcing drill cuttings from said first cylinder through said swing tube member to said discharge port and (iv) pause while said swing tube member is transitioned from alignment with the outlet of said first cylinder to alignment with the outlet of said second cylinder.

In still another aspect, a pump for moving drill cuttings includes a hopper for receiving drill cuttings. A swing tube member is positioned within the hopper with an outlet end in flow communication with a discharge port of the hopper, and an inlet end movable between first and second openings that communicate respectively with first and second pumping cylinders. The inlet end includes a wear ring member disposed thereabout for movement with the inlet end, the wear ring member abutting a stationary wear plate member adjacent a wall of the hopper, the stationary wear plate member defining the first and second openings. An internal pressure gap is formed between the inlet end of the swing tube member and the wear ring member so that pressure within the swing tube member reaches the pressure gap and acts on a pressure surface of the of the wear ring member to push the wear ring member against the stationary wear plate member.

In a further aspect, a pump for moving drill cuttings includes a hopper for receiving drill cuttings, the hopper including a front wall with a discharge port and a rear wall with first and second cylinder ports. A first pumping cylinder is in communication with the first cylinder port and a second pumping cylinder in communication with the second cylinder port. A swing tube member is positioned within the hopper and has an outlet end in communication with the discharge port, and an inlet end movable between first and second openings respectively associated with the first and second cylinder ports. The cylinder ports are at respective heights lower than a height of the discharge port. The hopper includes an inclined surface positioned with its upper end toward the front wall and its lower end toward the rear wall to direct drill cuttings in the hopper toward the first and second openings.

In yet a further aspect, a pump for moving drill cuttings includes a hopper for receiving drill cuttings, the hopper including a a discharge port and first and second cylinder ports. A first pumping cylinder is in communication with the first cylinder port and a second pumping cylinder is in communication with the second cylinder port. A swing tube member is positioned within the hopper and has an outlet end in communication with the discharge port, and an inlet end movable between first and second openings respectively associated with the first and second cylinder ports. At least an internal surface of the first and second pumping cylinders is a stainless steel material that work hardens during pumping operations.

DETAILED DESCRIPTION

Figure 1:
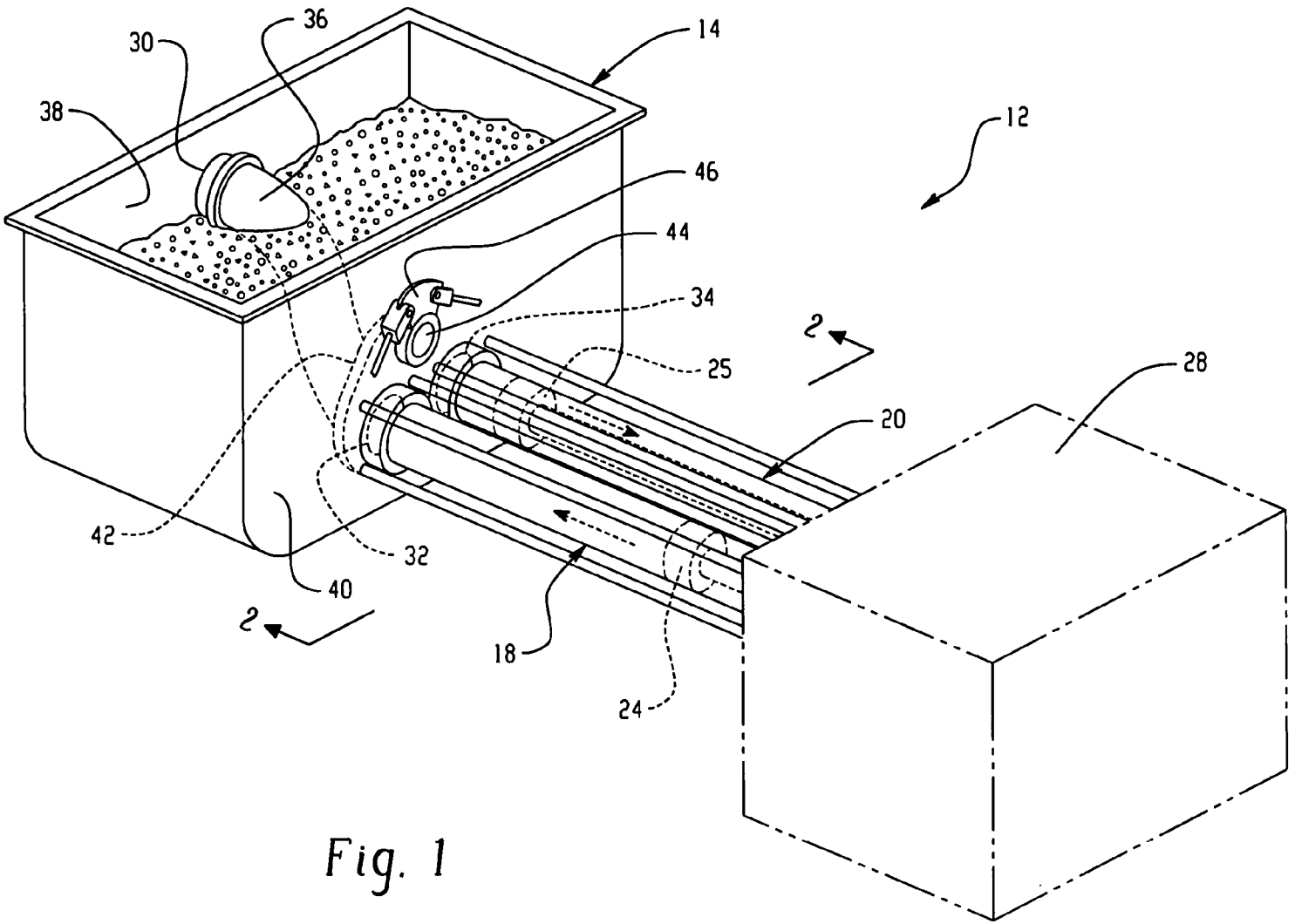
FIG. 1 is a diagrammatic depiction of a dual cylinder positive displacement pump.

A perspective view of one embodiment of a dual cylinder positive displacement pump 12 is provided in FIG. 1. The pump 12 is a hydraulically activated pump having a first and second hydraulic pumping cylinders 18 and 20 each having an associated piston 24, 25 positioned for reciprocating movement therein. The pistons 24 and 25 in cylinders 18 and 20 are reciprocated back and forth via a hydraulic control unit 28, sometimes also referred to as a power pack, (shown diagrammatically). The hopper 14 includes an outlet or discharge port 30 in a front wall 38 and two cylinder ports 32 and 34 in rear wall 40 communicating with cylinders 18 and 20. An S-shaped swing tube 36 is used to communicate between the cylinder ports 32 and 34 and the discharge port 30. The swing tube 36 has its outlet end pivotally connected in communication with the outlet port 30 front wall 38 and its inlet end is movable between the cylinder ports 32 and 34 in rear wall 40. The swing tube 36 may be supported by a swing tube bracket 42 inside the hopper 14, where movement of the bracket 42 effects movement of the inlet end of the swing tube.

The bracket 42 in turn is pivotally connected to the rear wall to 40 of hopper 14 on a shaft 44. The bracket 42 is fixed to the shaft 44 allowing it to swing back and forth and at the same time direct the swing tube back and forth to align with the ports 32 and 34. On the rearward side of rear wall 40 a collar 46 is keyed to shaft 44. The collar is rotated back and forth by hydraulic pistons 48 and 50 (FIG. 2) attached to the collar 46 by chevises 52 and 54. A single hydraulic piston, or some other mechanism, could also be used to effect movement of the swing tube 36.

The discharge port 30 may communicate with a discharge tube that includes a diversion valve which can be triggered to redirect drill cuttings from the discharge tube back along a feedback path, as may be defined by one or more tubes leading to a holding bin that communicates with hopper 14. Selective use of the feedback path can maintain the consistency of the drill cuttings when the flow of the drill cuttings through the discharge tube is terminated for one reason or another.

In operation drill cuttings are placed in hopper 14. The pistons 24 and 25 in cylinders 18 and 20 will reciprocate back and forth. When the piston 24 is moving rearwardly, the swing tube is in alignment with the cylinder 20 leaving the opening 32 in communication with the interior of the hopper 14. Thus, the drill cuttings are drawn into the cylinder 18 as the piston 24 is pulled backwards. At the same time the piston 25 in cylinder 20 is moving forward. The swing tube 36 is aligned with the port 34 and the drill cuttings are pushed by the piston 25 through the swing tube 36. Once the right piston 25 has completed its stroke, the hydraulic cylinders 48 and 50 attached to the collar 46 cause the swing tube 36 to swing in the opposite direction as indicated by arrow 68 aligning the swing tube 36 with the cylinder 18. During movement of the inlet end of the swing tube 36 movement of the pistons 24 and 25 is temporarily paused. Once the movement of the swing tube 36 is completed, the piston 24 in cylinder 18 then moves forward forcing the drill cuttings in the cylinder 18 through the swing tube 36. At the same time the piston 25 in the right cylinder 20 moves backwards drawing in drill cuttings. This action continues repeatedly so that drill cuttings continue to be drawn from the hopper into the pumping cylinders and then moved from the pumping cylinders along the swing tube to the discharge port 30 and into a discharge tube.

The foregoing description generally applies to the operation of dual cylinder positive displacement pumps. Certain features particularly useful for incorporation into such pumps in order to facilitate the pumping of drill cuttings will now be described.

Figure 2:
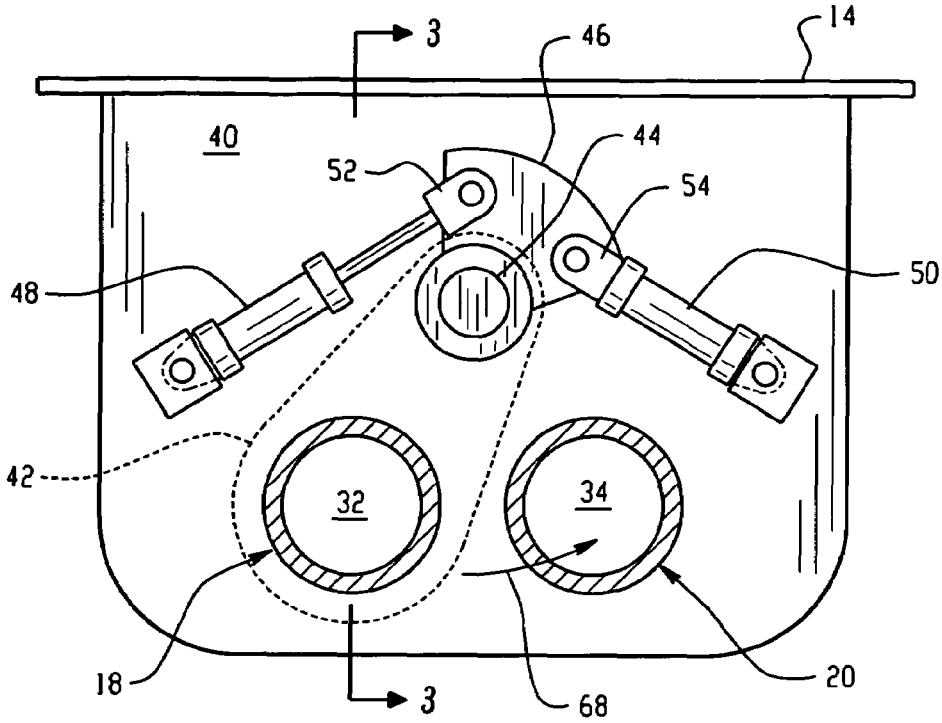
FIG. 2 is a cross-section taken at lines 2-2 of FIG. 1.

Referring to FIG. 2, the pumping cylinders 18 and 20 are formed of stainless steel, such as 316 Stainless. The stainless steel inner surface of the cylinders 18 and 20 work hardens over time as the result of pumping operations during which the pistons 24 and 25 slide along the inner surfaces of the cylinders. Problems with wear and leakage are thereby significantly reduced as compared to prior art cylinder materials, such as induction hardened steel (heat treated ST-52) and/or steel tubes chromed internally over a nickel bed layer. In one example the pistons 24 and 25 are formed of neoprene rubber over a heavy metal core, with the neoprene bonded to the metal. It is contemplated that the pumping cylinders may be of unitary construction, stainless steel throughout. As an alternative, the pumping cylinders may include an outer tube part of one material with an inner liner of stainless steel.

Figure 3:
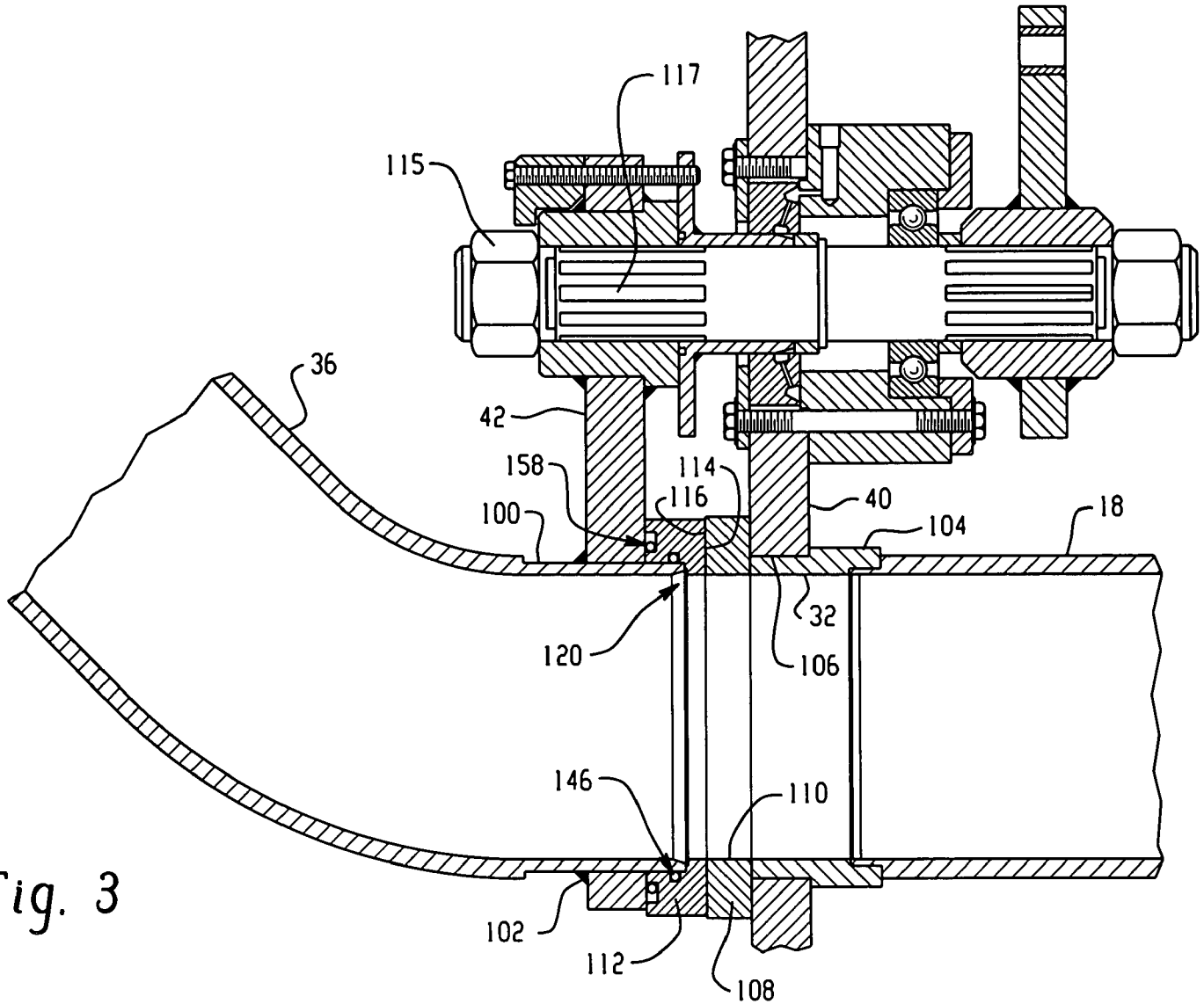
FIG. 3 is a cross-section of an exemplary interface of the inlet end of a swing tube with a cylinder port of the hopper.

Referring now to FIG. 3, a cross-sectional depiction at the inlet end 100 of swing tube 36 is provided. Swing tube bracket 42 is disposed about inlet end 100 and is rigidly connected thereto as by weld 102. The inlet end 100 is shown in alignment with cylinder port 32 of hopper rear wall 40, which communicates with pumping cylinder 18. The pumping cylinder 18 is connected with the hopper 14 via a cylinder wear ring 104 that fits within an opening 106 of the rear wall 40, with the inner diameter of the cylinder wear ring 104 defining the cylinder port 32. The end of pumping cylinder 18 is inwardly stepped and positioned within the outward facing end of cylinder wear ring 104. At the inside surface of rear wall 40 a stationary wear plate 108 is provided, with an opening 110 aligned with cylinder port 32. Another opening (not shown) in the wear plate aligns with the similar cylinder port 34 for the other pumping cylinder. A wear ring 112 is disposed about the swing tube inlet end 100 such that part of the inlet end is positioned within the wear ring 112 as shown. The wear ring 112 moves with the inlet end 100 and abuts against wear plate 108. During movement of the swing tube inlet end 100 and wear ring 112, annular surface 114 of wear ring 112 slides along surface 116 of wear plate 108.

Figure 4:
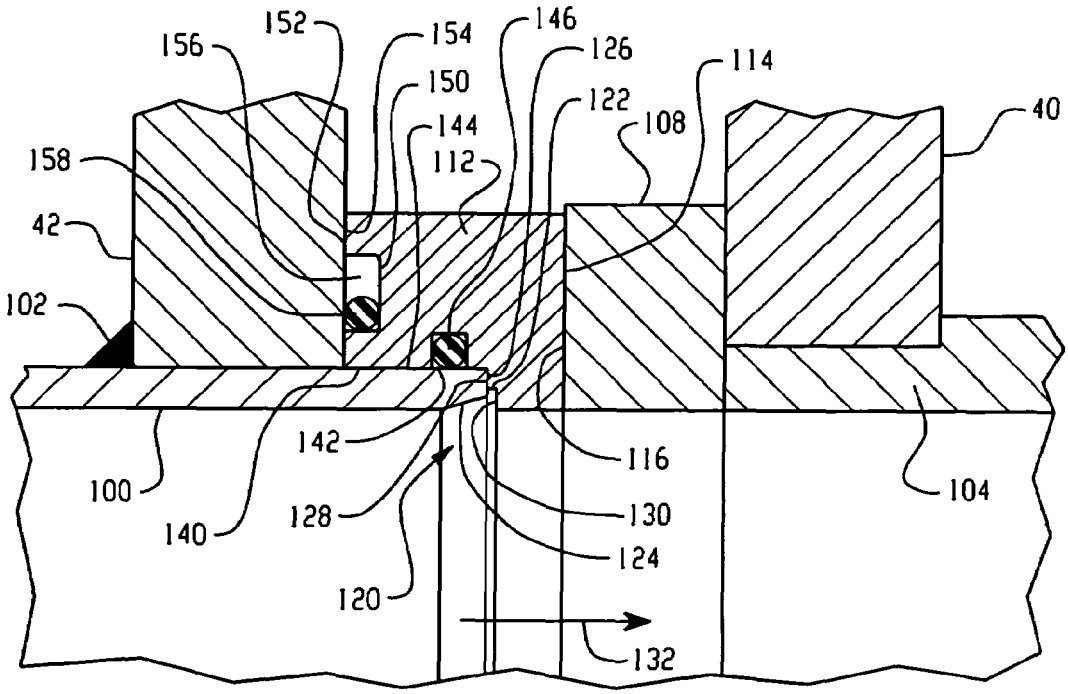
FIG. 4 is an enlarged partial cross-section of a portion of FIG. 3.

An internal pressure gap 120 is provided between the swing tube inlet end 100 and the wear ring 112 and is best understood with reference to the enlarged partial cross-section of FIG. 4. In particular, an outwardly stepped portion 122 along the inside of wear ring 112 aligns with an outwardly tapered inner surface portion 124 of the inlet end 100 of swing tube 36. Annular end surface 126 of swing tube inlet end 100 abuts against a corresponding annular surface 128 of the wear ring 112, to the outside of the pressure gap 120. Annular wear ring surface 130 of stepped portion 122 acts as a pressure responsive surface to hold annular wear ring surface 114 against the surface 116 of the wear plate 108. Pressure within the swing tube 36 (as well as the other parts of the drill cuttings flow path defined by the swing tube 36, wear ring 112 and wear plate 108) acts against pressure surface 130 to urge the wear ring 112 in the direction of arrow 132. Thus, as the pressure within the swing tube 36 increases (as during pumping discharge from the cylinder into the swing tube 36) the pressure applied to pressure surface 130 increases and the wear ring 112 is held against the wear plate with similarly increasing force/pressure to provide sufficient sealing between the wear ring 112 and wear plate 108. The increased pressure of surface 114 against surface 116 also aids in restricting undesired movement of the wear ring 112 relative to the wear plate during a pumping discharge from the cylinder. It is contemplated that the pressure within the swing tube may reach 50 bar (735 psi) or higher during pumping.

A radially inwardly facing annular recess is formed along inner surface portion 140 of the wear ring 112 to created annular gap or space 142 between the outer surface 144 of swing tube inlet end 100 and the wear ring 112. An o-ring 146, partially compressed within the gap 142, acts as a sealing ring between the wear ring 112 and the swing tube inlet end 100. Notably, the annular gap 142 is located near the pressure gap 120 but outside of the drill cuttings flow path.

During periods when drill cuttings are not being pumped from a cylinder into the swing tube 36 (e.g., when the swing tube inlet end 100 is being transitioned from one pumping cylinder to another) the pressure within the swing tube 36 may drop to equal the hydrostatic head of the material in the delivery pipeline, typically a drop of at least 80% as compared to the pressure during active pumping, removing much of the force holding the wear ring 112 against the wear plate 108. However, it is desirable to maintain some holding pressure between the two. In this regard, an axially facing annular recess 150 is provided in end face 152 of the wear ring, which end face 152 abuts against surface 154 of bracket 42, creating an annular gap 156. An o-ring 158 is positioned within the gap 156 and is partially compressed so as to hold the wear ring 112 in abutment with the wear plate 108 while still permitting the wear ring 112 to slide relative to the wear plate 108 during a transition from one cylinder to another. The o-ring 158, in combination with the position of securing nut 115, may hold the wear ring 112 into abutment with the wear plate 108 with a force of about 4 bar (58.8 psi), but it is recognized that variations are possible. Adjustment of the position of securing nut 115 along the spline shaft 117 can be used to achieve suitable abutment between the wear ring 112 and the wear plate 108. In one example, the wear ring 112 material may be HARDOX 400 and the wear plate material may be HARDOX 400, although variations are possible.

Figure 5:
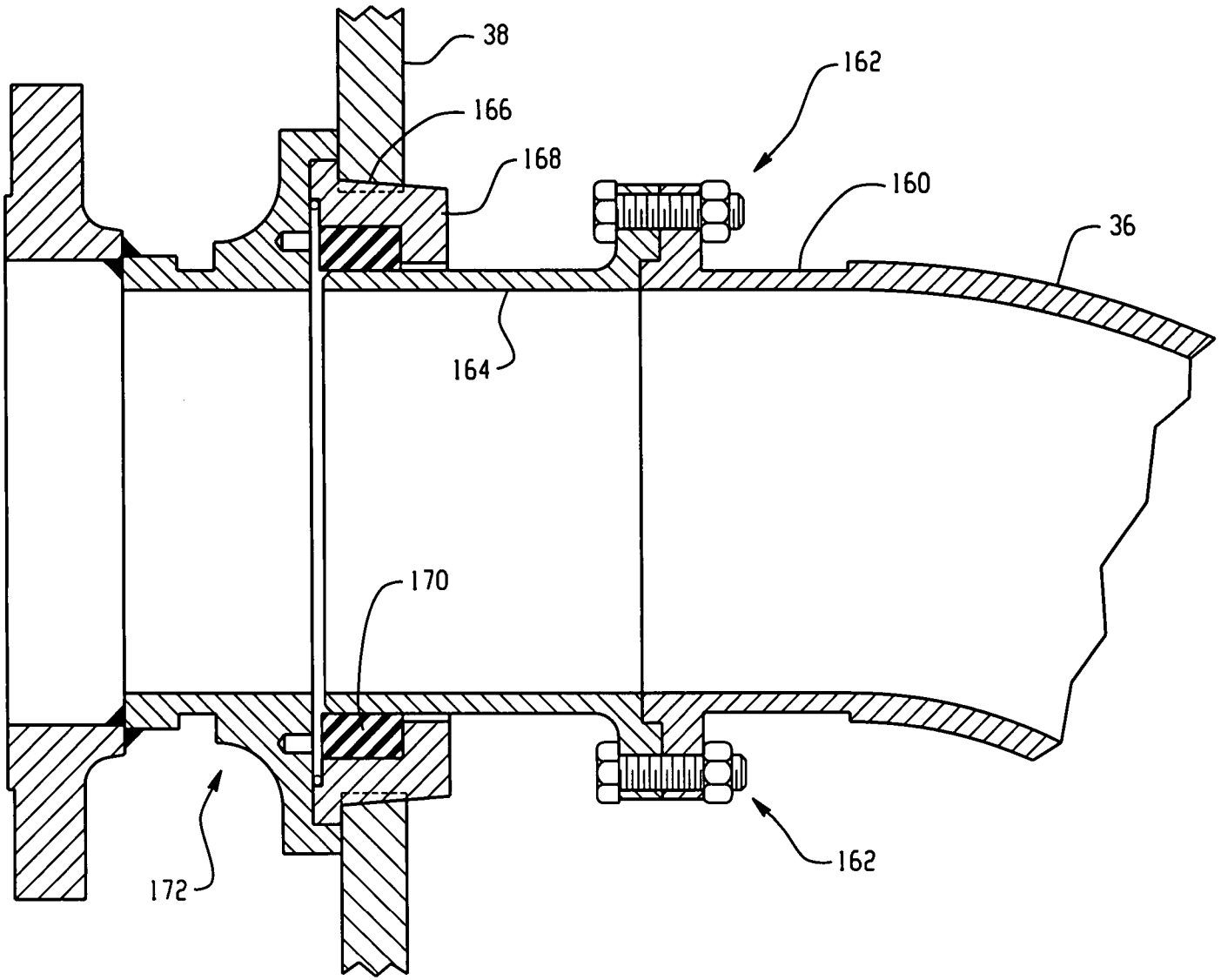
FIG. 5 is a cross-section of an exemplary interface of the outlet end of a swing tube with a discharge port of the hopper.

Referring to FIG. 5, a cross-section of discharge end 160 of swing tube 36 is shown. End 160 connects, as by nut and bolt assemblies 162, to an outlet connector 164, which may be formed of chrome. The front wall 38 of the hopper includes an opening 166 within which is positioned an outlet bushing/wear ring 168. The discharge end of connector 164 is positioned for rotation within the wear ring 168, with an annular seal 170 provided therebetween. A pump outlet flange assembly 172 is provided to the exterior side of hopper front wall 38 to facilitate connection of a discharge tube along which the drill cuttings will be pumped. It is contemplated that the inner diameter of the swing tube 36 will be constant along its length. During pivot of the swing tube 36, rotation of end 160 causes connector 164 to rotate relative to the wear ring 168 and annular seal 170.

Figure 6:
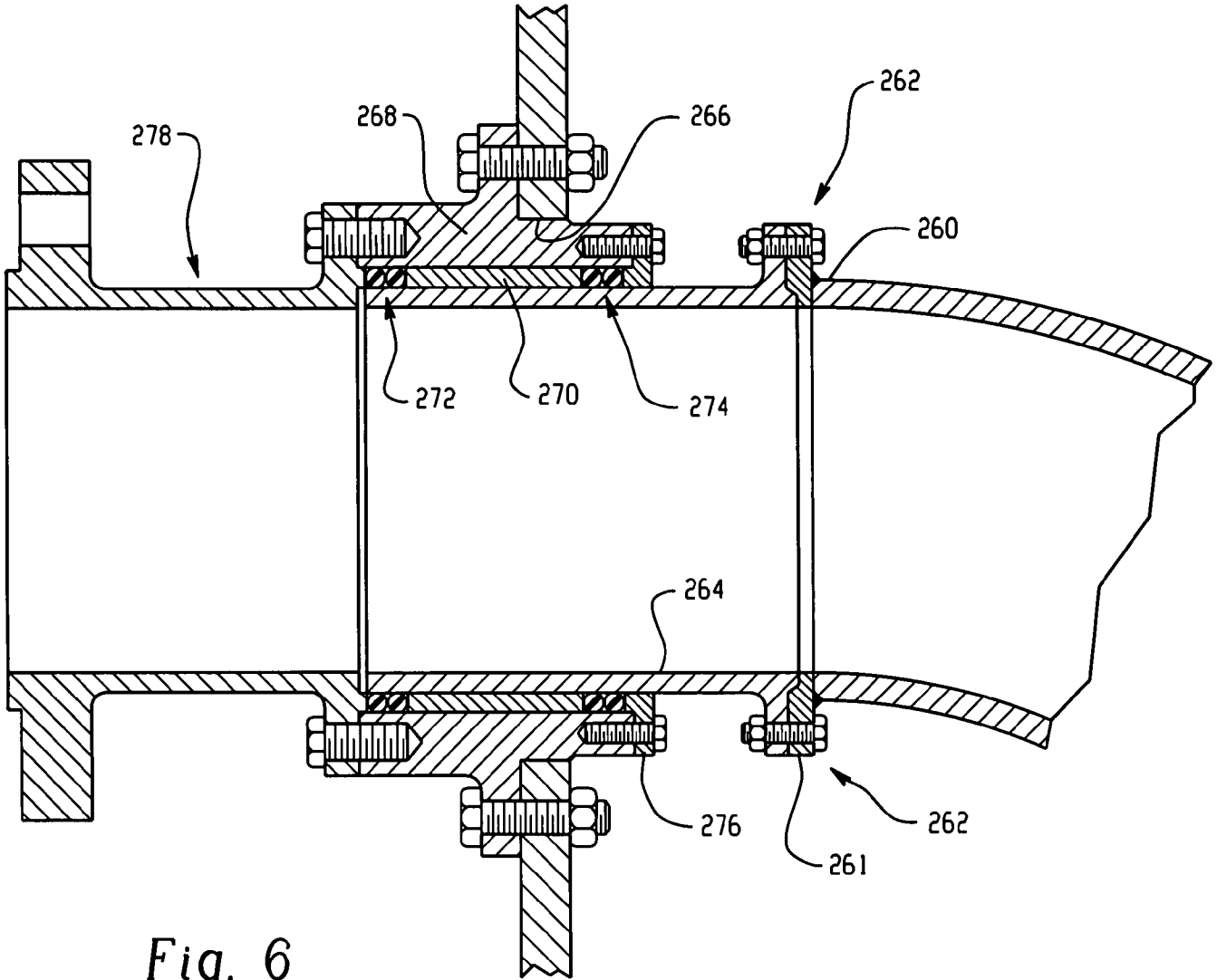
FIG. 6 is a cross-section of another exemplary interface of the outlet end of a swing tube with a discharge port of the hopper.

Referring to FIG. 6, a cross-section of an alternative embodiment of a discharge end 260 of a swing tube is shown. End 260 is welded to an annular plate 261, which is in turn connected with a chrome outlet connector 264 by nut and bolt assemblies 262. The front wall 38 of the hopper includes an opening 266 within which is positioned an outlet bearing and seal carrier 268, which is bolted to the front wall 38. The discharge end of connector 264 is positioned for rotation within the carrier 268, with an annular bearing 270 positioned between the inner surface of the carrier 268 and the outer surface of the connector 264. A pair of sealing o-rings 272 is positioned between the inner surface of the carrier 268 and the outer surface of the connector 264 at one end of the bearing 270 and a similar pair of sealing o-rings 274 is located at the other end of the bearing 270. A retaining plate 276 is bolted to the hopper interior end of carrier 268 and extends slightly inward radially to hold the o-ring pair 274 in place. A pump outlet flange assembly 278 is bolted to the other end of carrier 268 and also extends slightly inward radially to hold the o-ring pair 272 in place. During pivot of the swing tube 36, rotation of end 260 causes the connector 264 to rotate relative to the bearing 270 and carrier 268.

Figure 7:
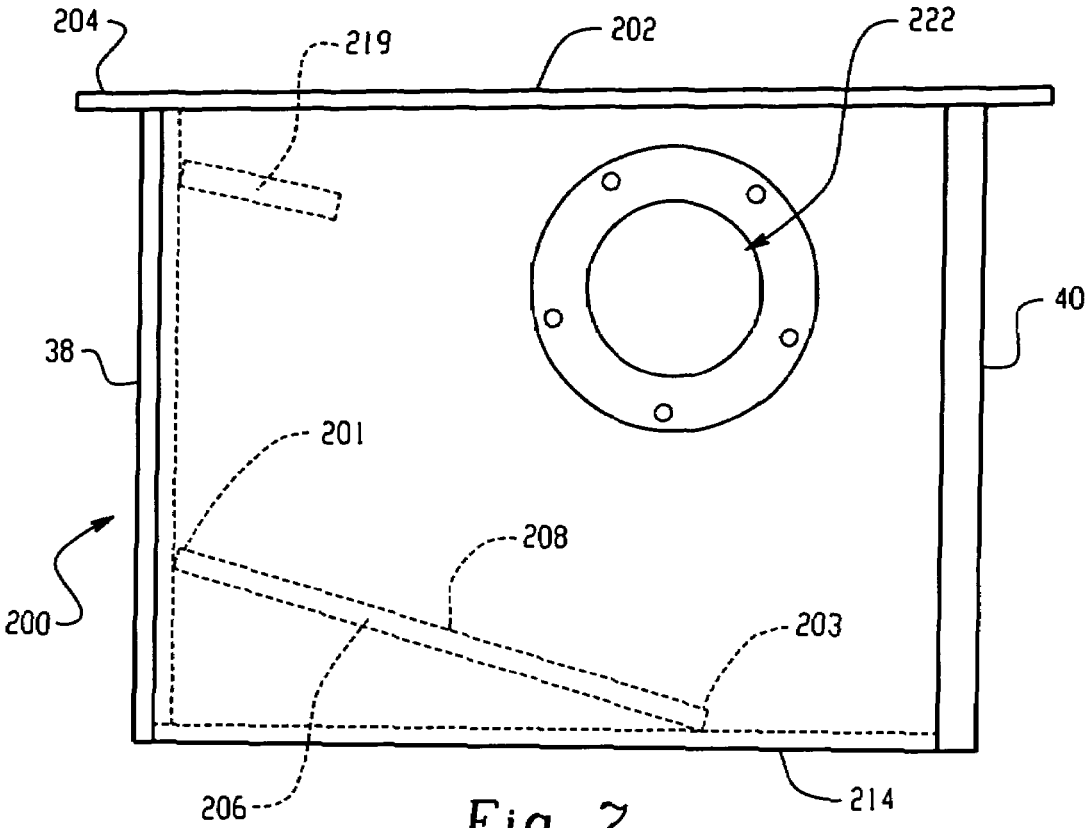
FIG. 7 is a side elevation of a hopper.
Figure 8:
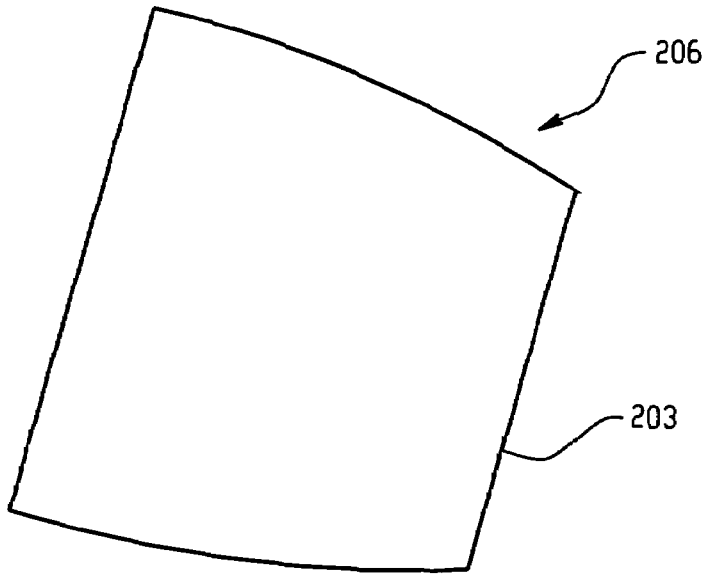
FIG. 8 is a top view of an inclined plate.
Figure 9:
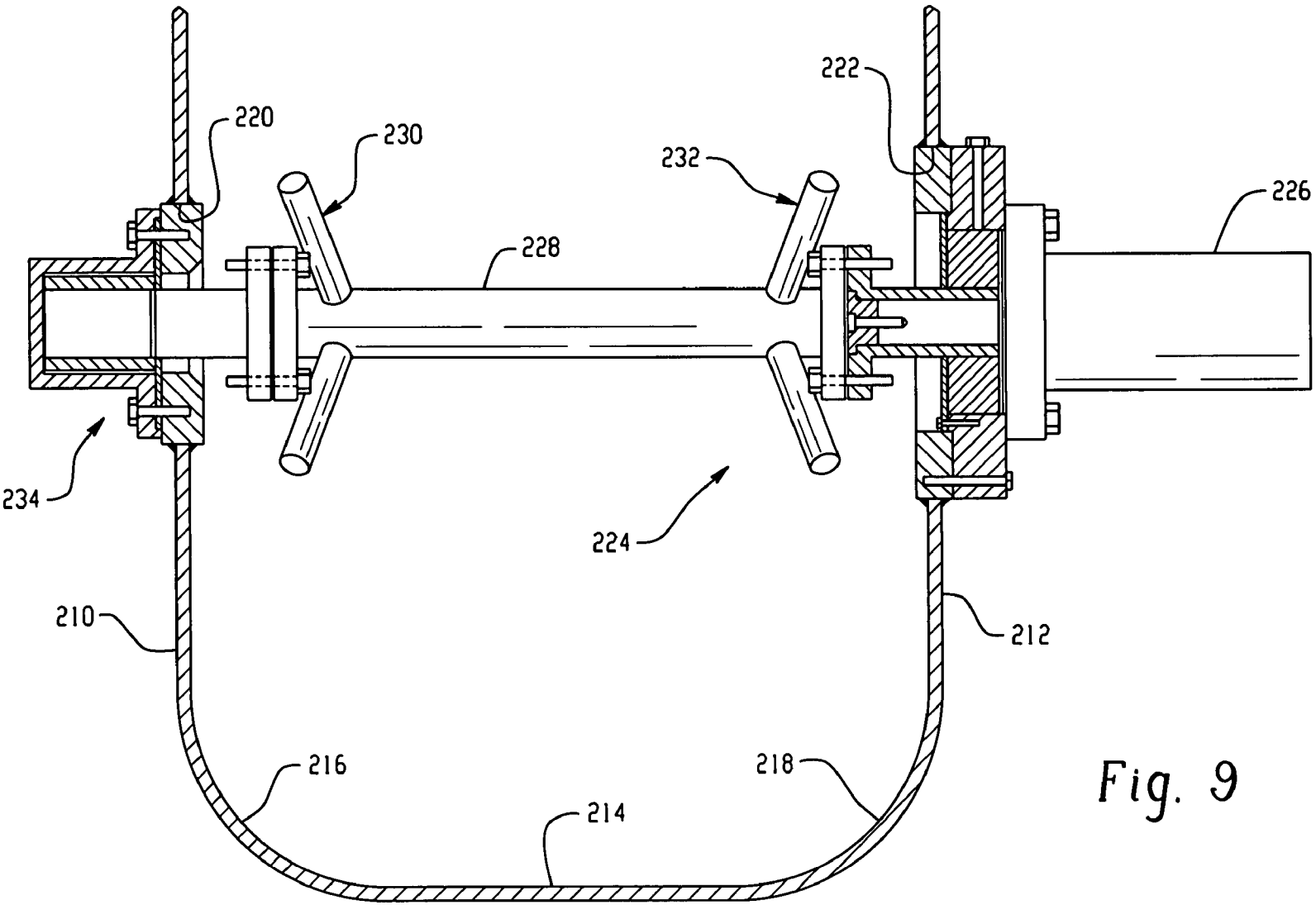
FIG. 9 is a cross-section illustrating an agitator assembly within a hopper.

Referring now to FIGS. 7-9, an exemplary hopper configuration is shown and described. Hopper 200 includes an opening 202 at its top surrounded by a connecting flange 204 having a plurality of fastener openings therein. As seen from the side elevation of FIG. 7, rear wall 40 is slightly taller than front wall 38 so that flange 204 angles downwardly from rear wall 40 toward front wall 38. An inclined plate 206 is located within the hopper toward the lower part of the volume defined by the hopper. The inclined plate 206 presents an inclined surface 208 to drill cuttings within the hopper directing them toward the rear wall 40 and the openings associated with the pumping cylinders in order to maintain drill cuttings in the area of the openings to the cylinders, thereby assuring high pumping efficiency. In the illustrated embodiment an upper end 201 of the plate 206 is positioned adjacent front wall 38, and lower end 203 of plate 206 is positioned against bottom wall 214 of the hopper. The plate 206 extends between spaced apart sidewalls 210, 212 (FIG. 9) of the hopper that connect the front wall 38 with the rear wall 40. Bottom wall 214 of the hopper is connected with sidewalls 210 and 212 via respective curved wall sections 216 and 218, which also aid in desired flow of drill cuttings within the hopper. As shown in the top view of FIG. 8, at least the lower end 203 of the plate 206 is tapered so that the width of the plate 206 changes as the width of the lower portion of the hopper changes due to the curvature of regions 216 and 218. Reinforcing brackets 219 are provided at the upper part of the hopper between the front wall 38 and the sidewalls 210 and 212. The brackets 219 angle downwardly as shown to cause drill cuttings that fall on the brackets to flow into the main volume of the hopper.

Sidewalls 210 and 212 include respective mount openings 220 and 222 for receiving an agitator assembly 224 shown in FIG. 9. Agitator assembly 224 includes a driving motor 226 mounted exteriorly of the hopper and associated with a primary agitator shaft 228 on which spaced apart agitator extensions 230 and 232 are provided. The opposite end of shaft 228 is associated with a bearing assembly 234 of the opening 220 in sidewall 210. Thus, the agitator assembly extends between sidewalls 210 and 212 to be supported above the swing tube 36 within the hopper 200. As reflected by the position of opening 222 shown in FIG. 7, the agitator assembly is positioned off-center of the front wall to rear wall length of the hopper 200, and particularly toward the rear wall 40. Rotation of the shaft 228 of agitator assembly 224 causes the agitator extensions 230 and 232 to work drill cuttings within the hopper.

The pumping capacity of a dual cylinder positive displacement pump for pumping drill cuttings will tend to vary with the size of the pump and the application to which the pump is applied (e.g., whether the pump is simply transferring drill cuttings from one storage location to another or whether the pump is being used to feed drill cuttings to a processing system having a limited capacity).

In one application a dual cylinder positive displacement pump is used on an offshore drilling platform to move drill cuttings into a unit for processing of the drill cuttings. In another application the pump is used to pump the drill cuttings off of an offshore platform onto a seagoing vessel such as a barge so that the drill cuttings can be transported to a land-based processing facility. In the latter case the pump may be associated with a movable discharge tube, such as a high pressure hose or conduit, that can be aligned with a hatch or other opening on the vessel.

This has been a description of the present invention and the preferred mode of practicing the invention, however, the invention itself should only be defined by the appended claims wherein we claim:

1. A method of moving drill cuttings, the method comprising placing drill cuttings in a hopper, said hopper including a swing tube member communicating between a discharge port and alternately with first and second pumping cylinders, the method comprising alternately reciprocating respective piston heads within said first and second cylinders in synchronization with movement and positioning of said swing tube member to repeatedly: (i) draw drill cuttings into said first cylinder while at the same time forcing drill cuttings from said second cylinder through said swing tube member to said discharge port, (ii) pause while said swing tube member is transitioned from alignment with an outlet from said second cylinder to alignment with an outlet from said first cylinder, (iii) subsequently draw drill cuttings into said second cylinder while at the same time forcing drill cuttings from said first cylinder through said swing tube member to said discharge port and (iv) pause while said swing tube member is transitioned from alignment with the outlet of said first cylinder to alignment with the outlet of said second cylinder, the method further comprising creating a pressure of at least 50 bar (735 psi) within the swing tube member during operations (i) and (iii), said pressure within said swing tube member dropping by at least 80% during operations (ii) and (iv).

2. The method of claim 1 further comprising periodically redirecting said drill cuttings through a feedback path downstream of said discharge port, the feedback path leading back into said hopper.

3. The method of claim 1 further comprising providing an interface between said swing tube member and a wear ring member that moves with said swing tube member and abuts against a stationary wear plate member against said hopper wall, the interface including an internal pressure gap formed between a moving end of the swing tube member and the wear ring member so that pressure within the swing tube member reaches the pressure gap and acts on a pressure surface of the wear ring member to push the wear ring member against the stationary wear plate member, thereby providing sufficient sealing between the wear ring member and wear plate member as the pressure within the swing tube member increases during steps (i) and (iii).

4. The method of claim 3 comprising the further step of providing a pressure ring within an annular gap formed in a downstream end face of the wear ring member and adjacent a swing tube bracket disposed about the swing tube member for effecting its movement, the pressure ring providing sufficient pressure to hold said wear ring member in abutment with said wear plate member while still permitting the wear ring member to slide relative to said wear plate member during steps (ii) and (iv).

5. The method of claim 1 comprising the further step of providing said first and second cylinders of a material of stainless steel such that an internal surface of each cylinder work hardens during pumping operations.

6. The method of claim 1 comprising the further step of directing drill cuttings within the hopper toward the outlets of said first and second cylinders.

7. The method of claim 6 wherein the drill cuttings are directed toward the cylinder outlets by an inclined plate positioned toward a bottom of the hopper.

8. The method of claim 1 wherein the method involves moving unprocessed drill cuttings from on an offshore drilling platform along a flow path to a containment area of a seagoing vessel.

9. The method of claim 1 wherein the method involves moving unprocessed drill cuttings on an offshore drilling platform into an on-platform processing system for the drill cuttings.

10. A pump for moving drill cuttings, the pump comprising:

a hopper for receiving drill cuttings;

a swing tube member positioned within the hopper and having an outlet end in flow communication with a discharge port of the hopper, an inlet end movable between first and second openings that communicate respectively with first and second pumping cylinders, the inlet end including a wear ring member disposed thereabout for movement with the inlet end, the wear ring member abutting a stationary wear plate member adjacent a wall of the hopper, the stationary wear plate member defining the first and second openings;

wherein an internal pressure gap is formed between the inlet end of the swing tube member and the wear ring member so that pressure within the swing tube member reaches the pressure gap and acts on a pressure surface of the wear ring member to push the wear ring member against the stationary wear plate member.

11. The pump of claim 10 wherein an internal surface of the inlet end of the swing tube member is outwardly tapered, and the wear ring member includes an internal step aligned with the outwardly tapered surface to at least in part define the pressure gap.

12. The pump of claim 11 wherein an annular end face of the inlet end of the swing tube member abuts a corresponding annular face of the wear ring member to define an outer limit of the pressure gap.

13. The pump of claim 12 wherein the inlet end of the swing tube member is disposed within the wear ring member, an annular gap is formed between an outer surface of the inlet end and an inner side of the wear ring member, a sealing ring is disposed within the annular gap, and the annular gap is located near the pressure gap but outside a drill cuttings flow path defined by the wear ring member and swing tube member.

14. The pump of claim 13 wherein a pressure ring is located to urge the wear ring member against the stationary wear plate member even in the absence of high pressure in the pressure gap, so as to hold said wear ring member in abutment with the wear plate member while still permitting the wear ring member to slide relative to the wear plate member.

15. The pump of claim 14 wherein the pressure ring is located in an annular gap formed in an end face of the wear ring member and adjacent a bracket connected with the swing tube member to effect movement of the inlet end, the bracket disposed about the swing tube member.

16. The pump of claim 10 wherein the inlet end of the swing tube member is disposed within the wear ring member, a sealing ring is located to provide a seal between the wear ring member and the swing tube member, a pressure ring is located to push the wear ring member against the stationary wear plate member even in the absence of high pressure in the pressure gap, so as to hold said wear ring member in abutment with the wear plate member while still permitting the wear ring member to slide relative to the wear plate member, with both the sealing ring and the pressure ring located outside a drill cuttings flow path defined by the wear ring member and swing tube member.

17. The pump of claim 10 wherein at least an internal surface of the first and second pumping cylinders is a stainless steel material that work hardens during pumping operations.

18. The pump of claim 17 wherein each of the first and second pumping cylinders is a single-piece tubular member formed entirely of stainless steel.

19. The pump of claim 10 wherein the hopper includes an inclined plate positioned to direct drill cuttings within the hopper toward the first and second openings.

20. The pump of claim 19 wherein a front wall of the hopper includes the discharge port, the wall adjacent the stationary wear plate member is a rear wall of the hopper, and an upper end of the inclined plate is located against the front wall, and a lower end of the inclined plate is positioned against a bottom surface of the hopper causing drill cuttings that move downward along the inclined plate to be directed away from the front wall.

21. A pump for moving drill cuttings, the pump comprising:

a hopper for receiving drill cuttings;

a swing tube member positioned within the hopper and having an outlet end in flow communication with a discharge port of the hopper, an inlet end movable between first and second openings that communicate respectively with first and second pumping cylinders, the inlet end including a wear ring member disposed thereabout for movement with the inlet end, the wear ring member abutting a stationary wear plate member adjacent a wall of the hopper, the stationary wear plate member defining the first and second openings; and a bracket member comprising:

a first surface that abuts a surface of the wear ring member that is opposite the wear plate member, and a second surface that abuts the swing tube member;

wherein the inlet end of the swing tube member is disposed within the wear ring member, a sealing ring is located to provide a seal between the wear ring member and the swing tube member, and a pressure ring is located adjacent to and directly between the bracket member and the wear ring member to push the wear ring member against the stationary wear plate member so as to hold said wear ring member in abutment with the wear plate member while still permitting the wear ring member to slide relative to the wear plate member, and wherein both the sealing ring and the pressure ring are located outside a drill cuttings flow path defined by the wear ring member and swing tube member.

22. The pump of claim 21 wherein at least an internal surface of the first and second pumping cylinders is a stainless steel material that work hardens during pumping operations.

23. The pump of claim 22 wherein each of the first and second pumping cylinders is a single-piece tubular member formed entirely of stainless steel.

24. The pump of claim 21 wherein the hopper includes an inclined plate positioned to direct drill cuttings within the hopper toward the first and second openings.

25. A pump for moving drill cuttings, the pump comprising:

a hopper for receiving drill cuttings, the hopper including a front wall with a discharge port and a rear wall with first and second cylinder ports;

a first pumping cylinder in communication with the first cylinder port;

a second pumping cylinder in communication with the second cylinder port;

a swing tube member positioned within the hopper and having an outlet end in communication with the discharge port, an inlet end movable between first and second openings respectively associated with the first and second cylinder ports, the cylinder ports at respective heights lower than a height of the discharge port, wherein the hopper includes an inclined surface positioned with its upper end toward the front wall and its lower end toward the rear wall to direct drill cuttings in the hopper toward the first and second openings, wherein the inclined surface is formed by an inclined plate positioned within a lower portion of the hopper.

26. The pump of claim 25 wherein spaced apart side walls of the hopper extend from the front wall to the rear wall, curved regions are provided between the side walls and a bottom wall of the hopper, and the inclined plate is tapered toward one end to match the curved regions.

27. The pump of claim 26 wherein the inclined plate is welded to the hopper.

28. The pump of claim 25 wherein spaced apart side walls of the hopper extend from the front wall to the rear wall, an agitator assembly is provided within the hopper, the agitator assembly extending between the sidewalls to support an agitator within the hopper and above the swing tube member toward the inlet end of the swing tube member.

* * * * *